United States Patent [19]

Murasaki et al.

[11] Patent Number: 4,809,034

[45] Date of Patent: Feb. 28, 1989

[54] DEVELOPING DEVICE

[75] Inventors: Hiroshi Murasaki, Ibaragi; Hiroshi Mizuno, Ikoma; Akihito Ikegawa, Sakai; Kouichi Etou, Takatsuki, all of Japan

[73] Assignee: Minolta Camera Kabushiki Kaisha, Osaka, Japan

[21] Appl. No.: 51,377

[22] Filed: May 19, 1987

[30] Foreign Application Priority Data

May 21, 1986 [JP] Japan ..... 61-117929

[51] Int. Cl.[4] ..... G03G 15/08

[52] U.S. Cl. ..... 355/3 DD; 355/14 D; 118/652; 118/658

[58] Field of Search ..... 355/3 DD, 14 D; 118/652, 656–658, 661

[56] References Cited

U.S. PATENT DOCUMENTS

| | | | |
|---|---|---|---|
| 3,965,862 | 6/1976 | Yang et al. | 118/652 X |
| 4,338,880 | 7/1982 | Tabuchi et al. | 355/3 DD X |
| 4,349,270 | 9/1982 | Wada et al. | 355/3 DD X |
| 4,410,259 | 10/1983 | Yamagata et al. | 355/3 DD |
| 4,615,606 | 10/1986 | Nishikawa | 355/3 DD |
| 4,619,517 | 10/1986 | Ruhland | 355/3 DD |
| 4,760,422 | 7/1988 | Seimya et al. | 355/3 DD |

FOREIGN PATENT DOCUMENTS

| | | | |
|---|---|---|---|
| 58-223158 | 12/1983 | Japan | 355/3 DD |

*Primary Examiner*—A. C. Prescott
*Assistant Examiner*—Jane Lau
*Attorney, Agent, or Firm*—Wenderoth, Lind & Ponack

[57] ABSTRACT

A developing device includes a developing sleeve which is provided with a plurality of magnets so as to transport a two-component developer composed of toner and carrier to a developing region where the developing sleeve and a member bearing an electrostatic latent image confront each other, a toner reservoir, a toner supply roller for supplying the toner to the developing sleeve, which is disposed at an end portion of the toner reservoir so as to be brought into contact with the toner in the toner reservoir, a rotary member which is rotatably provided in the toner reservoir so as to be rotated in contact with the toner supply roller and a charge erasing member for erasing electric charge of electrically charged toner transported to the toner reservoir by the toner supply roller.

10 Claims, 2 Drawing Sheets

DEVELOPING DEVICE

BACKGROUND OF THE INVENTION

The present invention relates to a developing device for use in an image forming apparatus such as a copying apparatus or the like.

A developing device has been proposed in, for example, U.S. Pat. No. 4,615,606 which includes a developing sleeve 4 having a magnetic roller 5 incorporated therein, a toner supply roller 7 formed, on its surface, with minute recesses and confronting the developing sleeve 4 across a predetermined gap extending therebetween and a toner reservoir 3 disposed above or at a side of the toner supply roller 7 as shown in FIG. 1. The magnetic roller 5 comprising a plurality of magnets arranged in a circumferential direction of the developing sleeve 4 such that magnetic poles of the magnets extend in an axial direction of the developing sleeve 4.

In the known developing device referred to above, developer held on the surface of the developing sleeve 4 forms a magnetic brush along lines of magnetic force of the magnets provided in the magnetic roller 5 and the magnetic brush rubs against a surface of a member bearing an electrostatic latent image such that a visible toner image is formed on the surface of the member bearing the electrostatic latent image. A potential difference is established between the developing sleeve 4 and the toner supply roller 7 such that the developing sleeve 4 is replenished with an amount of toner corresponding to an amount of the toner to be consumed.

However, in the known developing device, the filling of the minute recesses of the toner supply roller 7 with new toner is facilitated by a scooping action of the minute recesses of the toner supply roller 7 and the device does not have means for positively filling the minute recesses with new toner. Namely, the known developing device has a drawback in that the filling efficiency is low and thus, the toner cannot be sufficiently supplied to the developing sleeve 4.

Thus, in order to improve the efficiency of filling the minute recesses with toner, the present inventors provided in the toner reservoir a rotary means for forcibly causing the toner to flow towards the toner supply roller. As a result, the filling efficiency of the toner was improved. However, electrically charged toner adhering to the toner supply roller falls into the toner reservoir by action of the rotary means and is mixed with new toner in the toner reservoir, consequently electrostatically aggregating the new toner. Thus, another problem arises in that when the aggregated toner is supplied to the developing sleeve so as to be used for development, the aggregated toner causes fog in a copied image.

SUMMARY OF THE INVENTION

Accordingly, an essential object of the present invention is to provide a developing device by which an excellent copied image free from fog in its substrate can be obtained.

Another important object of the present invention is to provide a developing device in which an efficiency for filling minute recesses of a toner supply roller with toner is improved and which has a function of erasing electric charge of electrically charged toner transported to a toner reservoir.

In order to accomplish these objects of the present invention, a developing device according to the present invention comprises: a developing sleeve which is provided therein with a plurality of magnets so as to transport on its outer peripheral surface a two-component developer composed of toner and carrier to a developing region where said developing sleeve and a member bearing an electrostatic latent image confront each other; a toner reservoir for accommodating the toner; a toner supply roller for supplying the toner to said developing sleeve, which is disposed at an end portion of said toner reservoir so as to be brought into contact with the toner in said toner reservoir such that the toner is held on an outer peripheral surface of said toner supply roller; a rotary means which is rotatably provided in said toner reservoir and is rotated while contacting said toner supply roller; and a charge erasing the means for erasing electric charge of electrically charged toner transported to said toner reservoir by said toner supply roller.

BRIEF DESCRIPTION OF THE DRAWINGS

These objects and features of the present invention will become apparent from the following description taken in conjunction with the preferred embodiment thereof with reference to the accompanying drawings, in which:

FIG. 3 is a sectional view of a developing device of FIG. 2, but showing a modification thereof according to the present invention, and FIG. 4 is a sectional view of a developing device of FIG. 2 but showing another modification thereof according to the present invention.

Before the description of the present invention proceeds, it is to be noted that like parts are designated by like reference numerals throughout the accompanying drawings.

DETAILED DESCRIPTION OF THE PREFERRED EMBODIMENT

Figure 1:
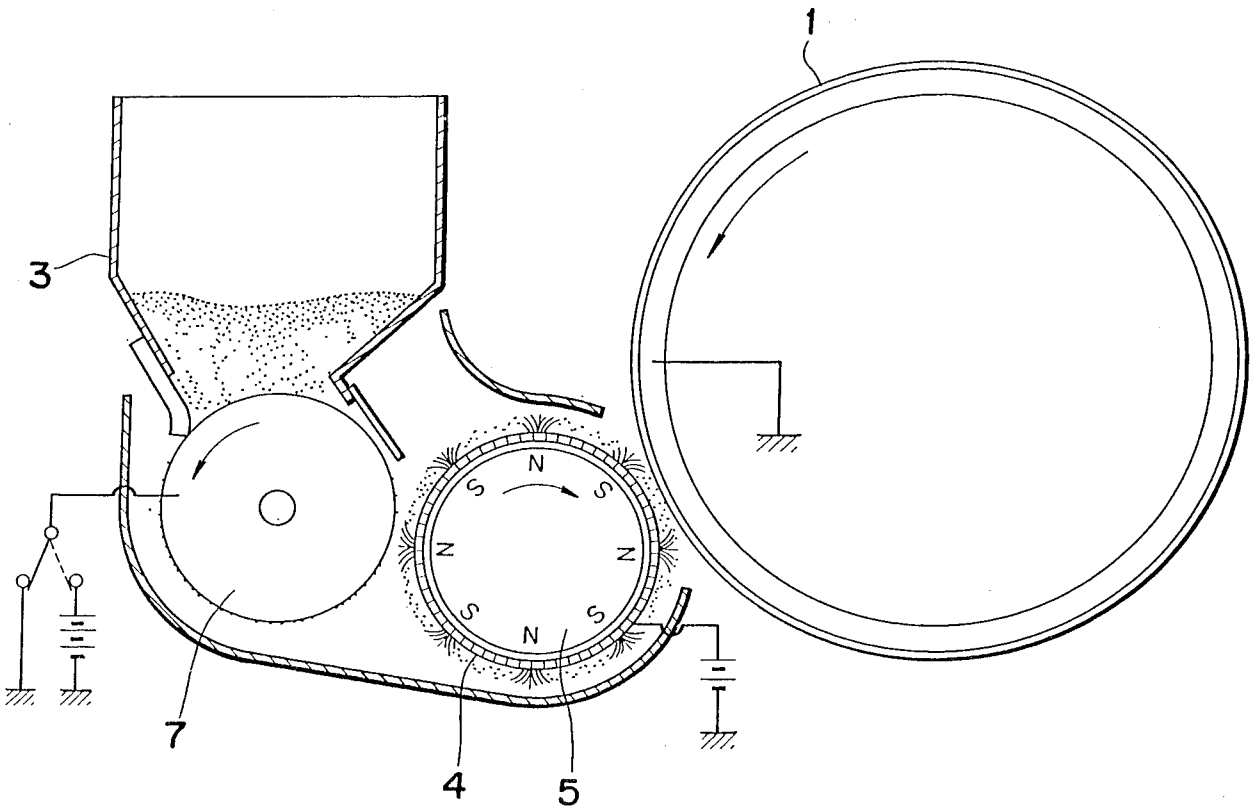
Fig. 1 PRIOR ART
FIG. 1 is a sectional view of a prior art developing device (already referred to)
Figure 2:
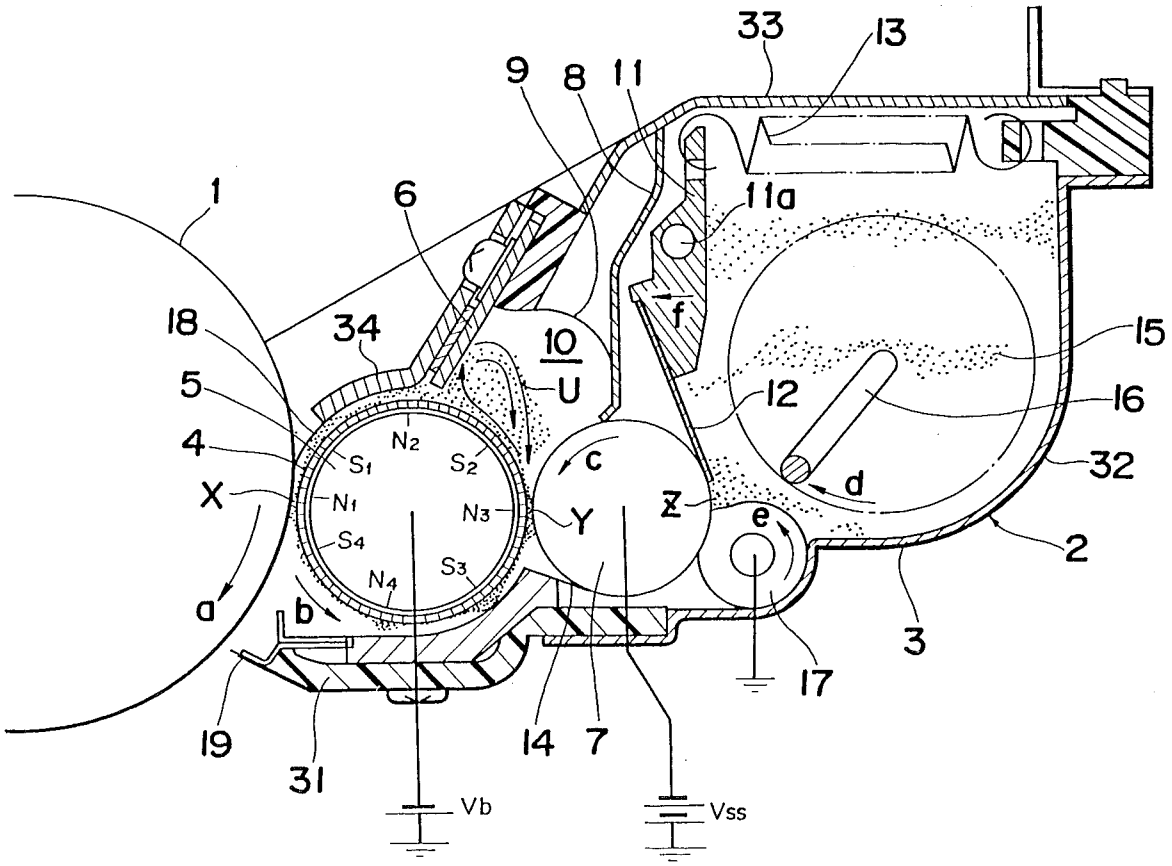
FIG. 2 is a sectional view of a developing device according to the present invention.

FIG. 2 shows a developing portion of a copying apparatus provided with a developing device 2 according to the present invention. The developing device 2 is provided at a side of a photosensitive or photoreceptor drum 1. An electrostatic latent image of an image to be copied is formed on the surface of the photosensitive drum 1 through corona charging and exposure of the surface of the photosensitive drum 1. The developing device 2 supplies toner to the electrostatic latent image so as to develop the electrostatic latent image into a visible toner image. In FIG. 2, the developing device 2 includes a developing sleeve 4 and a toner supply roller 7 which are arranged in the foregoing order to the right of the photosensitive drum 1 in a developing tank 3 consisting substantially of casings 31, 32, 33 and 34. In the developing tank 3, a toner reservoir 15 is defined at a right side of the toner supply roller 7.

The developing sleeve 4 is made of an electrically conductive non-magnetic material such as aluminium and has a cylindrical shape. The developing sleeve 4 is formed, on its surface, with minute recesses by blasting and is provided adjacent to the photosensitive drum 1, rotated in direction of the arrow a, so as to be rotated counterclockwise in the direction of arrow b. Meanwhile, a DC developing bias power source having a bias voltage Vb is connected between the developing sleeve 4 and ground. The negative terminal of the developing bias power source is connected to the developing sleeve 4 and thus, negative electric charge is accumulated on the surface of the developing sleeve 4.

A magnetic roller 5 is incorporated in the developing sleeve 4 and comprises a plurality of magnets having magnetic poles N1 to N4 and S1 to S4 extending in an axial direction of the developing sleeve 4 such that the N(north)-poles N1 to N4 and the S(south)-poles S1 to S4 are arranged alternately along the outer peripheral surface of the developing sleeve 4. The magnetic roller 5 is secured at the position shown in FIG. 2. The magnetic pole N1 confronts the photosensitive roller 1, while the magnetic pole N3 is disposed diametrically opposite to the magnetic pole N1 and confronts the toner supply roller 7. The magnetic pole N2 is disposed at an upper portion of the magnetic roller 5 and is slightly offset, in the transport direction (arrow b) of the developer, from a portion of the magnetic roller 5 confronting a bristle height regulating plate 6 to be described below.

The bristle height regulating plate 6 is attached to the casing 34 and is disposed upwardly and to the right of the developing sleeve 4 so as to be inclined rightwardly. The bristle height regulating plate 6 confronts the developing sleeve 4 such that a predetermined bristle height regulating gap is defined therebetween. The bristle height regulating plate 6 limits the height of a magnetic brush formed on the surface of the developing sleeve 4 so as to adjust amount of the developer transported to a developing region X where the photosensitive drum 1 and the developing sleeve 4 confront each other.

Meanwhile, a film 18 for preventing scatter of the toner from the developing tank 3 is attached to the casing 34 so as to be disposed above the developing region X, while a plate 19 for receiving the toner falling down from the developing tank 3 is fixed to the casing 21 so as to be disposed below the developing region X.

The toner supply roller 7 is made of an electrically conductive non-magnetic material such as aluminium. The toner supply roller 7 is formed, on its surface, with a pattern defined by minute recesses each having a depth of 5 to 60 μm and is formed with an insulating film by anodizing. The toner supply roller 7 is disposed adjacent to the developing sleeve 4 and remotely from the photosensitive drum 1 so as to axially extend parallel to the developing sleeve 4 and is rotated in the direction of arrow C. Meanwhile, a DC collecting bias power source having a bias voltage Vss is connected between the toner supply roller 7 and ground. The negative terminal of the collecting bias power source is connected to the toner supply roller 7 and, thus, negative electric charge is accumulated on the surface of the toner supply roller 7. Since the bias voltage Vss is set so as to be higher than the bias voltage Vb, the electric potential on the surface of the toner supply roller 7 is lower than that on the surface of the developing sleeve 4.

Above the toner supply roller 7, a developer receiving plate 8 is attached to the casing 33 so as to confront the toner supply roller 7. Above an area where the toner supply roller 7 and the developing sleeve 4 confront each other, a space 10 is defined by the bristle height regulating plate 6, the developer receiving plate 8 and a sheet 9.

Meanwhile, at a side of the toner supply roller 7 remote from the developing sleeve 4 and disposed upwardly from the toner supply roller 7, a partition wall 11 is pivotally supported for rotation about a support shaft 11*a*, with the supper portion of said partition wall 11 being connected to one end of a tension spring 13, the other end of which is connected to an upper rear portion of the developing tank 3 so as to normally urge partition wall 11 in the direction of the arrow f. Thus, a toner regulating blade 12 made of ribbon steel and having a thickness of 0.1 mm is attached to a lower portion of the partition wall 11 so as to be brought into pressing contact with the surface of the toner supply roller 7 at a force of about 1.0 g/mm against the rotational direction (arrow c) of the toner supply roller 7 by the tension spring 13.

Furthermore, below the toner supply roller 7, a film 14 for preventing a return of the toner is attached to the casing 31 so as to be brought into pressing contact with the surface of the toner supply roller 7 along the rotational direction (arrow c) of the toner supply roller 7.

The toner reservoir 15 is bounded, in a rear portion of the developing tank 3, by the partition wall 11, the toner regulating blade 12, the toner supply roller 7 and the film 14. In the toner reservoir 15, a stirring rod 16 and a transport roller 17 are rotatably provided so as to be rotated in the directions of arrows d and e, respectively. The transport roller 17 is made of a porous and electrically conductive material such as polyurethane foam and is grounded and held in contact with both the toner supply roller 7 and a bottom portion of the casing 32. Specifically, since the transport roller 17 is pressed against on the toner supply roller 7, air in the transport roller 17 is blown to a toner replenishment zone Z during rotation of the transport roller 17.

Hereinbelow, operation of the developing device 2 of the above-described arrangement is described. Initially, a starter, which is a mixture of magnetic carrier having a negative electric charge and insulating toner having a positive electric charge, is loaded into the space 10 disposed above the developing sleeve 4 and the toner supply roller 7, while the insulating toner is loaded into the toner reservoir 15. At this time, only the magnetic carrier can be loaded into the space 10 instead of the above-described starter. Thus, it becomes possible to develop an electrostatic latent image into a visible image by the developing device 2.

When a print switch (not shown) is turned on in this state, the develoing sleeve 4, the toner supply roller 7, the stirring rod 16 and the transport roller 17 are rotated in the directions of arrows b, c, d and e, respectively.

During the above-described operation of the developing device 2, the toner in the bottom portion of the toner reservoir 15 flows towards the toner supply roller 7 under the stirring action of the stirring rod 16. At this stage, the toner is not aggregated but has a relatively high bond strength. Since air in the transport roller 17 is blown to the toner replenishment zone Z due to the contact of the transport roller 17 with the toner supply roller 7, when the toner reaches the toner replenishment zone Z disposed above the toner supply roller 7 and the transport roller 17, the bond strength of the toner is weakened by the blown air such that the toner is properly pulverized into fine particles. The pulverized toner is readily deposited in the minute recesses of the toner supply roller 7 to as to fill the minute recesses of the toner supply roller 7.

The toner supplied to the toner supply roller 7 is transported in the direction of arrow c with surplus toner being scraped off from the toner supply roller 7 by the toner regulating blade 12 and is electrically charged preliminarily through its contact with the toner regulating blade 12 so as to proceed to a toner supply region Y where the toner supply roller 7 and the developing sleeve 4 confront each other.

In the toner supply region Y, the developer held on the developing sleeve 4 is transported in an erect state along the lines of magnetic force generated from the magnetic pole N3. With this magnetic brush on the developing sleeve 4, the toner on the toner supply roller 7 is scraped off therefrom. In addition, the toner is electrostatically attracted by the carrier to the developing sleeve 4 and thus, is supplied from the toner supply roller 7 to the developing sleeve 4.

At the same time, surplus toner on the developing sleeve 4 is collected by the toner supply roller 7. This collecting action of the toner supply roller 7 is described later. Thus, in the toner supply region Y, delivery of the toner is properly performed between the developing sleeve 4 and the toner supply roller 7 such that concentration of the toner in the developer on the developing sleeve 4 is maintained at a proper value.

The toner supplied, at one portion of the toner supply region Y confronting the magnetic pole N3, from the toner supply roller 7 to the surface of the developing sleeve 4 is transported, during rotation of the developing sleeve 4, in the direction of arrow b together with the developer held on the developing sleeve 4. When the toner and the developer have reached a front face of the bristle height regulating plate 6, most of the developer and the toner is blocked by the bristle height regulating plate 6 and thus, is pushed by the subsequently transported developer so as to readily rise sharply along the bristle height regulating plate 6. Thereafter, the developer and the toner fall down on the developing sleeve 4 so as to be refed to the developing sleeve 4.

Namely, in the space 10 in front of the bristle height regulating plate 6, the developer is properly stirred to obtain a uniform mix thereof while forming vortexes (U), with the toner being triboelectrically charged through contact with the carrier to a level sufficient for performing development and then, the mixed developer is uniformly supplied on the developing sleeve 4.

A portion of the developer thus sufficiently stirred passes through the gap between the bristle height regulating plate 6 and the developing sleeve 4 so as to form a magnetic brush on the developing sleeve 4. This magnetic brush rubs against the surface of the photosensitive drum 1 at the developing region X so as to develop an electrostatic latent image on the surface of the photosensitive drum 1 into a visible toner image.

After passing through the developing region X, the developer remaining on the outer peripheral surface of the developing sleeve 4 is successively transported in the direction of arrow 6 during rotation of the developing sleeve 4 and then, reaches the toner supply region Y where the developing sleeve 4 and the toner supply roller 7 confront each other. At this time, new toner is supplied to the developing sleeve 4 by the toner supply roller 7. When the toner has reached the space 10 again, the sufficiently stirred developer forming the vortexes (U) is uniformly replenished to the surface of the developing sleeve 4 so as to eliminate a consumption pattern of the toner consumed in the previous development.

On the other hand, since the surface of the toner supply roller 7 has a volage lower than that of the surface of the developing sleeve 4 in the toner supply region Y, a surplus portion of the toner electrically charged to a positive polarity is collected by the toner supply roller 7 through electrostatic attraction due to the potential difference between the toner supply roller 7 and the developing sleeve 4 such that a mixing ratio of the toner in the developer on the developing sleeve 4 is kept constant.

Meanwhile, if an AC controller bias voltage is applied to the toner supply roller 7 in addition to the DC collecting bias voltage Vss, control speed and operational stability of the developing device 2 can be improved.

The toner thus collected by the toner supply roller 7 is deposited in the minute recesses on the surface of the toner supply roller 7 and then, proceeds between the toner supply roller 7 and the film 14 so as to enter the toner reservoir 15.

When the collected toner held on the surface of the toner supply roller 7 and having positive electric charge is brought into contact with the transport roller 17, the positive electric charge of the toner is removed by the transport roller 17 connected to ground and thus, the toner becomes electrically neutral. Meanwhile, a portion of the collected toner, which has been released from the surface of the toner supply roller 7 by the transport roller 17 or during rotation of the transport roller 17, moves along the bottom portion of the casing 32 and is brought into contact with the transport roller 17 when passing through contacting surfaces of the transport roller 17 and the casing 32, so that electric charge of the toner is removed by the transport roller 17. Therefore, a phenomenon in which the collected toner is mixed with new toner so as to be aggregated or set does not occur. Furthermore, even if the collected toner is transported on the toner supply roller 7 and the developing sleeve 4 and then, is used for developing, fog of a copied image is not produced.

In the above-described embodiment, the transport roller 17 is made of an electrically conductive material and is connected to ground. However, the transport roller 17 can also be made of an insulating material, while the casing 32 is made of an electrically conductive material and is connected to ground such that electric charge of the electrically charged toner is removed through the casing 32. In addition, a DC bias voltage having a polarity opposite to that of the toner can be applied to at least one of the transport roller 17 and the casing 32. Meanwhile, in the embodiment in which electric charge of the electrically charged toner is removed through the casing 32, it is not necessary to insulate the surface of the toner supply roller 7.

Meanwhile, the rotational direction of the transport roller 17 is not limited to that of arrow e in the embodiment described above and thus, the transport roller 17 can also be rotated in a direction opposite to that illustrated by arrow e. In this case, although the amount of the toner transported and a charge erasing property are inferior compared to the same the above-described embodiment, the collected toner released from the toner supply roller 7 moves together with new toner between the toner supply roller 7 and the transport roller 17 by the movement of the toner during rotation of the transport roller 17 and thus, the toner whose electric charge is removed is refed to the toner supply roller 7. Accordingly, in this case, the transport roller 17 is not required to be held in contact with the casing 32.

Furthermore, in the above-described embodiment, the soft porous roller 17 made of polyurethane foam or the like an employed as the rotary means provided in the toner reservoir 15 can be replaced by a roller having a brush fitted therearound.

As will be seen from the foregoing description, in the developing device of the present invention in which new toner accommodated in the toner reservoir is supplied to the surface of the developing sleeve by the toner supply roller and the two-component developer composed of the toner and the carrier is adjusted on the developing sleeve, there are provided in the toner reservoir, the rotary means to be rotated while contacting the toner supply roller and the charge erasing means for erasing electric charge of the electrically charged toner transported into the toner reservoir by the toner supply roller.

Therefore, in accordance with the present invention, since the amount of the toner held by the toner supply roller is increased by the rotary means, a necessary amount of the toner for development can be supplied to the toner supply roller and the developing sleeve.

Furthermore, in accordance with the present invention, since electric charge of the electrically charged toner falling down in the toner reservoir is erased by the charge erasing means, an undesirable phenomenon in which the electrically charged toner is mixed with new toner in the toner reservoir so as to be aggregated or set does not occur. Accordingly, the proper toner pulverized into fine particles is used for development and thus, copied images of high quality can be obtained.

Although the above described embodiment has been described as to a developing device using two-component developer, the present invention is applicable to other developing devices using mono-component developer essentially consisting of toner by using the toner supply roller itself as a developing roller.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as being included therein.

What is claimed is:

1. A developing device for developing a latent image formed on a latent image-bearing membeer, said device comprising:

a developing sleeve confronting the latent image-bearing member and between which a developing region is defined, said developing sleeve for transporting toner to the developing region and including a plurality of magnets for attracting toner to the outer peripheral surface of said sleeve;

a casing in which a toner reservoir is defined for containing toner;

a toner supply roller disposed between said toner reservoir and said developing sleeve and in contact with toner when the toner is contained in said toner reservoir, said toner supply roller for transporting toner from said toner reservoir to said developing sleeve;

a rotary means disposed in said toner reservoir and contacting said toner supply roller and said casing in which said toner reservoir is defined, said rotary means for urging toner contained in said toner reservoir toward said toner supply roller when said toner reservoir is filled with toner while contacting said toner supply roller and said casing; and charge erasing means for removing electric charge from electrically charged, toner that has been transported by said toner supply roller, at the location at which said rotary means contacts said casing.

2. A developing device as claimed in claim 1, wherein said rotary means comprises electrically conductive material and is grounded.

3. A developing device as claimed in claim 1, wherein said rotary means comprises electrically conductive material; and wherein said erasing means comprises a voltage source operatively electrically connected to said rotary means for applying a charge to said rotary means that is opposite the charge of the electrically charged toner.

4. A developing device as claimed in claim 1, wherein said casing comprises electrically conductive material and is grounded.

5. A developing device as claimed in claim 1, wherein said casing comprises electrically conductive material; and wherein said erasing means comprises a voltage source operatively electrically connected to said casing for applying a charge to said casing that is opposite to the charge of the electrically charged toner.

6. A developing device for developing a latent image formed on a latent image-bearing member, said device comprising:

a casing in which a toner reservoir is defined for containing toner;

a toner support roller disposed between said toner reservoir and the latent image-bearing member and in contact with toner when the toner is contained in said toner reservoir, said toner support roller for transporting the toner toward the latent image-bearing member;

a rotary means disposed in said toner reservoir and contacting said toner support roller and said casing in which said toner reservoir is defined, said rotary means for urging toner contained in said toner reservoir toward said toner support roller when said toner reservoir is filled with toner while contacting said toner support roller and said casing; and charge erasing means for removing electric charge from electrically charged toner, that has been transported by said supply roller, at the location at which said rotary means contacts said casing.

7. A developing device as in claim 6, wherein said rotary means comprises electrically conductive material and is grounded.

8. A developing device as in claim 6, wherein said rotary means comprises electrically conductive material; and wherein said erasing means comprising a voltage source operatively electrically connected to said rotary means for applying a charge to said rotary means that is opposite the charge of the electrically charged toner.

9. A developing device as in claim 6, wherein said casing comprises electrically conductive material and is grounded.

10. A developing device as in claim 6,
wherein said casing comprises electrically conductive material; and
wherein said erasing means comprises a voltage source operatively electrically connected to said casing for applying a charge to said casing that is opposite to the charge of the electrically charged toner.

* * * * *